US010340592B2

(12) United States Patent
Nam et al.

(10) Patent No.: US 10,340,592 B2
(45) Date of Patent: Jul. 2, 2019

(54) ELECTRONIC DEVICE INCLUDING MULTIPLE ANTENNAS

(71) Applicant: Samsung Electronics Co., Ltd., Gyeonggi-do (KR)

(72) Inventors: Ho Jung Nam, Gyeonggi-do (KR); Min Cheol Seo, Seoul (KR); Hae Yeon Kim, Gyeonggi-do (KR); Se Hyun Park, Gyeonggi-do (KR)

(73) Assignee: Samsung Electronics Co., Ltd (KR)

( * ) Notice: Subject to any disclaimer, the term of this patent is extended or adjusted under 35 U.S.C. 154(b) by 0 days.

(21) Appl. No.: 15/664,772

(22) Filed: Jul. 31, 2017

(65) Prior Publication Data

US 2018/0034148 A1 Feb. 1, 2018

(30) Foreign Application Priority Data

Jul. 29, 2016 (KR) ..... 10-2016-0097564

(51) Int. Cl.
*H01Q 1/52* (2006.01)
*H01Q 5/35* (2015.01)
(Continued)

(52) U.S. Cl.
CPC ..... *H01Q 1/523* (2013.01); *H01Q 1/243* (2013.01); *H01Q 1/50* (2013.01); *H01Q 5/35* (2015.01); *H01Q 9/42* (2013.01); *H01Q 21/28* (2013.01)

(58) Field of Classification Search
CPC ..... H01Q 1/52; H01Q 1/523; H01Q 1/50; H01Q 1/243; H01Q 5/35
See application file for complete search history.

(56) References Cited

U.S. PATENT DOCUMENTS 7,403,164 B2 7/2008 Sanz et al.
7,411,556 B2 8/2008 Sanz et al.
(Continued)

FOREIGN PATENT DOCUMENTS

CN 104577334 4/2015
KR 101231768 2/2013
(Continued)

OTHER PUBLICATIONS

European Search Report dated May 23, 2018 issued in counterpart application No. 17761177.9-1205, 7 pages.
(Continued)

*Primary Examiner* — Hoang V Nguyen
(74) *Attorney, Agent, or Firm* — The Farrell Law Firm, P.C.

(57) ABSTRACT

An electronic device is provided. The electronic device includes a first antenna configured to transmit and receive signals of a plurality of frequency bands, and a second antenna disposed at an area adjacent to the first antenna. The first antenna includes a first wireless communication circuit, a first radiator, a first feeding part configured to connect the first wireless communication circuit to the first radiator, a first ground part configured to be connected to one end of the first radiator, a switching circuit configured to be connected to the first radiator in an area adjacent to the second antenna, at least one frequency band element in which a first end is connected to the switching circuit and a second end is connected to the first ground part, and at least one isolation element configured to connect the first radiator to the ground part in the area adjacent to the second antenna.

22 Claims, 9 Drawing Sheets

(51) Int. Cl.

| | |
|---|---|
| ***H01Q 1/24*** | (2006.01) |
| ***H01Q 1/50*** | (2006.01) |
| ***H01Q 9/42*** | (2006.01) |
| ***H01Q 21/28*** | (2006.01) |

(56) References Cited

U.S. PATENT DOCUMENTS

| | | | |
|---|---|---|---|
| 7,423,592 | B2 | 9/2008 | Pros et al. |
| 7,595,759 | B2 | 9/2009 | Schlub et al. |
| 7,675,470 | B2 | 3/2010 | Sanz et al. |
| 7,808,438 | B2 | 10/2010 | Schlub et al. |
| 7,893,883 | B2 | 2/2011 | Schlub et al. |
| 7,898,485 | B2 | 3/2011 | Schlub et al. |
| 8,094,079 | B2 | 1/2012 | Schlub et al. |
| 8,253,633 | B2 | 8/2012 | Sanz et al. |
| 8,259,016 | B2 | 9/2012 | Sanz et al. |
| 8,456,365 | B2 | 6/2013 | Pros et al. |
| 8,648,752 | B2 | 2/2014 | Ramachandran et al. |
| 8,674,887 | B2 | 3/2014 | Sanz et al. |
| 8,907,850 | B2 | 12/2014 | Schlub et al. |
| 9,531,061 | B2 | 12/2016 | Han et al. |
| 9,673,507 | B2 | 6/2017 | Ramachandran et al. |
| 9,774,074 | B2 | 9/2017 | Tsai et al. |
| 2005/0259031 | A1 | 11/2005 | Sanz et al. |
| 2007/0046548 | A1 | 3/2007 | Pros et al. |
| 2007/0152894 | A1 | 7/2007 | Sanz et al. |
| 2008/0165063 | A1 | 7/2008 | Schlub et al. |
| 2008/0211722 | A1 | 9/2008 | Sanz et al. |
| 2009/0033561 | A1 | 2/2009 | Pros et al. |
| 2009/0273526 | A1 | 11/2009 | Schlub et al. |
| 2009/0275370 | A1 | 11/2009 | Schlub et al. |
| 2009/0278753 | A1 | 11/2009 | Schlub et al. |
| 2009/0303139 | A1 | 12/2009 | Schlub et al. |
| 2010/0123642 | A1 | 5/2010 | Sanz et al. |
| 2011/0193754 | A1 | 8/2011 | Schlub et al. |
| 2012/0044124 | A1 | 2/2012 | Sanz et al. |
| 2012/0206302 | A1 | 8/2012 | Ramachandran et al. |
| 2012/0287001 | A1 | 11/2012 | Sanz et al. |
| 2013/0122828 | A1 | 5/2013 | Choi |
| 2013/0249768 | A1 | 9/2013 | Anguera Pros et al. |
| 2014/0225787 | A1 | 8/2014 | Ramachandran et al. |
| 2014/0300518 | A1* | 10/2014 | Ramachandran ..... H01Q 1/243 343/702 |
| 2015/0138036 | A1 | 5/2015 | Harper |
| 2016/0064801 | A1 | 3/2016 | Han et al. |
| 2016/0079656 | A1 | 3/2016 | Tsai et al. |
| 2016/0111777 | A1 | 4/2016 | Yang |
| 2016/0111794 | A1 | 4/2016 | Yang |
| 2016/0141751 | A1 | 5/2016 | Harper |
| 2016/0149291 | A1 | 5/2016 | Park |
| 2016/0226139 | A1 | 8/2016 | Yu et al. |
| 2016/0233574 | A1* | 8/2016 | Xiong ..... H01Q 5/50 |
| 2017/0012347 | A1* | 1/2017 | Ohguchi ..... H01Q 1/44 |

FOREIGN PATENT DOCUMENTS

| | | |
|---|---|---|
| KR | 1020130053801 | 5/2013 |
| KR | 101563459 | 10/2015 |
| WO | WO 2015/125383 | 8/2015 |

OTHER PUBLICATIONS

International Search Report dated Nov. 20, 2017 issued in counterpart application No. PCT/KR2017/008198, 12 pages.

* cited by examiner

ELECTRONIC DEVICE INCLUDING MULTIPLE ANTENNAS

PRIORITY

This application claims priority under 35 U.S.C. § 119(a) to a Korean Patent Application filed on Jul. 29, 2016, in the Korean Intellectual Property Office and assigned Serial No. 10-2016-0097564, the entire disclosure of which is incorporated herein by reference.

BACKGROUND

1. Field of the Disclosure

The present disclosure relates generally to an electronic device including multiple antennas.

2. Description of the Related Art

In recent years, demands for mobile communication services have been growing exponentially as mobile communication systems develop rapidly. Especially, as the demands for services using a wireless communication increase, the use of electronic devices including a wireless communication module is become increasingly common.

With the wireless communication technology, a variety of types of information, such as a text, an image, a video, a voice, etc., are transmitted and received. The wireless communication technology is evolving to enable more information to be transmitted and received faster. Along with the development of the wireless communication technology, electronic devices that are able to communicate wirelessly, such as a smartphone, a tablet, etc., provide services using a communication function of digital multimedia broadcasting (DMB), a global positioning system (GPS), Wi-Fi, long-term evolution (LTE), and the like. The electronic device includes at least one antenna to provide services as such. As a result, the number of frequency bands required to provide various services using the wireless communications increases. Accordingly, the electronic device requires a plurality of antennas. However, in a case that the multiple antennas are disposed in a limited space of the electronic device, which is lightweight, thin, short in length, and small in size, it is difficult to secure an isolation between antennas. Therefore, radiation performance of the antenna is deteriorated due to interference occurring between the antennas, and it is difficult to optimize a resonance formation in a desired frequency band.

SUMMARY

The present disclosure has been made to address at least the above-mentioned problems and/or disadvantages and to provide at least the advantages described below.

Accordingly, an aspect of the present disclosure is to provide an electronic device including a first antenna that is provided with an isolation element disposed at an area adjacent to a second antenna to isolate the first and the second antenna from each other.

In accordance with an aspect of the present disclosure, an electronic device including a plurality of antennas is provided. The electronic devices includes a first antenna configured to transmit and receive signals of a plurality of frequency bands, and a second antenna disposed at an area adjacent to the first antenna. The first antenna includes a first wireless communication circuit, a first radiator, a first feeding part configured to connect the first wireless communication circuit to the first radiator, a first ground part configured to be connected to one end of the first radiator, a switching circuit configured to be connected to the first radiator in an area adjacent to the second antenna, at least one frequency band element in which a first end is connected to the switching circuit and a second end is connected to the first ground part, and at least one isolation element configured to connect the first radiator to the ground part in the area adjacent to the second antenna.

In accordance with another aspect of the present disclosure, an electronic device is provided. The electronic device includes a housing including a first surface facing a first direction, a second surface facing a second direction opposite to the first direction, and a side surface surrounding at least a portion of a space between the first surface and the second surface, a first conductive member configured to be included in the housing or to form a portion of the housing, a ground member configured to be included in the housing, a switching circuit including a first terminal, a second terminal, and a third terminal, the first terminal configured to be electrically connected to a first point of the first conductive member, a first circuit configured to be electrically connected between the second terminal of the switching circuit and the ground member, where the first circuit includes at least one of a capacitance element and an inductance element, a second circuit configured to be electrically connected between the third terminal of the switching circuit and the ground member, where the second circuit comprises at least one of a capacitance element and an inductance element, a third circuit including at least one of a capacitance element and an inductance element, which is electrically connected to the first point of the first conductive member, the first terminal of the switching circuit, and the ground member, a first wireless communication circuit configured to be electrically connected to a second point spaced apart from the first point of the first conductive member, and a conductive connection part configured to electrically connect a third point spaced apart from the first point of the first conductive member and the ground member.

BRIEF DESCRIPTION OF THE DRAWINGS

The above and other aspects, features, and advantages of the present disclosure will be more apparent from the following description taken in conjunction with the accompanying drawings, in which.

DETAILED DESCRIPTION OF EMBODIMENTS OF THE PRESENT DISCLOSURE

Figure 1:
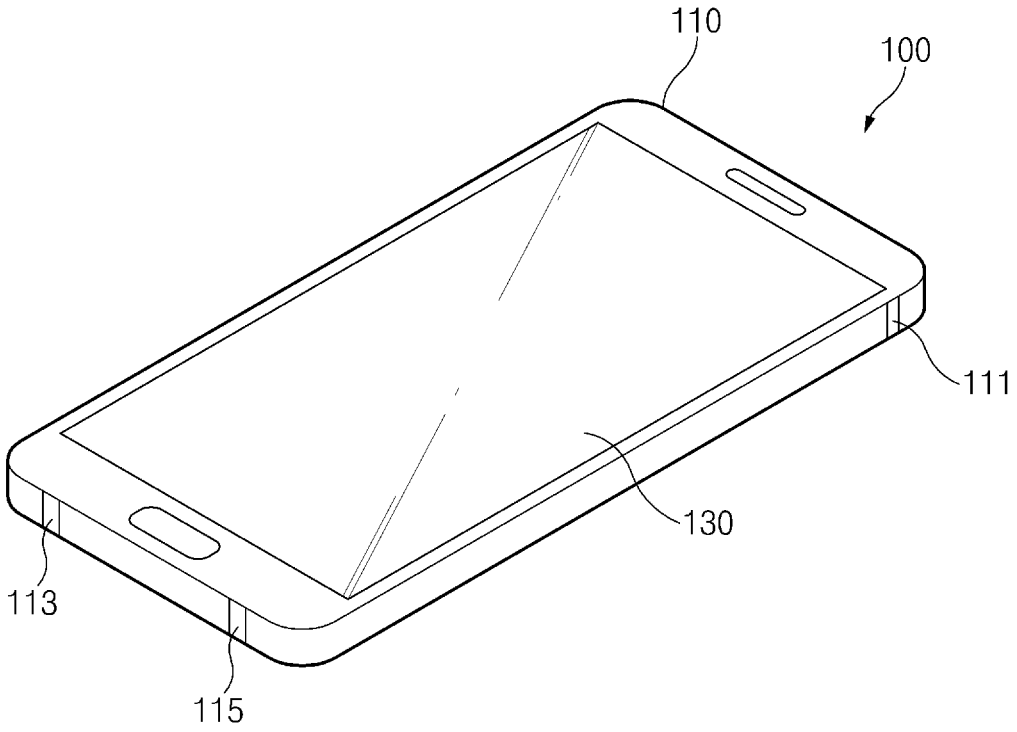
FIG. 1 is a perspective view of an electronic device including multiple antennas, according to an embodiment of the present disclosure.

Hereinafter, various embodiments of the present disclosure are described with reference to the accompanying drawings, in which like reference numerals are used to depict the same or similar elements, features, and structures. However, the present disclosure is not intended to be limited by the various embodiments described herein to a specific embodiment and it is intended that the present disclosure covers all modifications, equivalents, and/or alternatives of the present disclosure, provided they come within the scope of the appended claims and their equivalents. The terms and words used in the following description and claims are not limited to their dictionary meanings, but, are merely used to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural forms as well, unless the context clearly dictates otherwise. Thus, for example, reference to "a component surface" includes reference to one or more of such surfaces.

The terms "include," "comprise," and "have", used herein, indicate disclosed functions, operations, or the existence of elements, but does not exclude other functions, operations, or elements.

For example, the expressions "A or B," or "at least one of A and/or B" may indicate A and B, A, or B. For instance, the expression "A or B" or "at least one of A and/or B" may indicate (1) A, (2) B, or (3) both A and B.

Terms such as "1st," "2nd," "first," "second," and the like, used herein, may be used to modify various different elements of the present disclosure, but are not intended to limit the elements. For instance, "a first user device" and "a second user device" may indicate different users regardless of order or importance. For example, a first component may be referred to as a second component and vice versa without departing from the scope and spirit of the present disclosure.

In various embodiments of the present disclosure, it is intended that when a component (for example, a first component) is referred to as being "coupled" or "connected" with/to another component (for example, a second component), the component may be directly connected to the other component or may be connected through another component (for example, a third component). In contrast, when a component (for example, a first component) is referred to as being "directly coupled" or "directly connected" with/to another component (for example, a second component), another component (for example, a third component) does not exist between the component and the other component.

The expression "configured to", used in describing various embodiments of the present disclosure, may be used interchangeably with expressions such as "suitable for," "having the capacity to," "designed to," "adapted to," "made to," and "capable of", for example, according to the situation. The term "configured to" may not necessarily indicate "specifically designed to" in terms of hardware. Instead, the expression "a device configured to" in some situations may indicate that the device and another device or part are "capable of" For example, the expression "a processor configured to perform A, B, and C" may indicate a dedicated processor (for example, an embedded processor) for performing a corresponding operation or a general purpose processor (for example, a central processing unit (CPU) or an application processor (AP)) for performing corresponding operations by executing at least one software program stored in a memory device.

The terms used herein are to describe certain embodiments of the present disclosure, but are not intended to limit the scope of other embodiments. Unless otherwise indicated herein, all terms used herein, including technical or scientific terms, may have the same meanings that are generally understood by a person skilled in the art. In general, terms defined in a dictionary should be considered to have the same meanings as the contextual meanings in the related art, and, unless clearly defined herein, should not be understood differently or as having an excessively formal meaning In any case, even terms defined in the present disclosure are not intended to be interpreted as excluding embodiments of the present disclosure.

An electronic device according to various embodiments of the present disclosure may include at least one of a smartphone, a tablet personal computer (PC), a mobile phone, a video telephone, an electronic book reader, a desktop PC, a laptop PC, a netbook computer, a workstation, a server, a personal digital assistant (PDA), a portable multimedia player (PMP), a motion picture experts group (MPEG-1 or MPEG-2) audio layer 3 (MP3) player, a mobile medical device, a camera, or a wearable device. The wearable device may include at least one of an accessory-type device (e.g., a watch, a ring, a bracelet, an anklet, a necklace, glasses, a contact lens, a head-mounted device (HMD)), a textile or clothing-integrated-type device (e.g., an electronic apparel), a body-attached-type device (e.g., a skin pad or a tattoo), or a bio-implantable-type device (e.g., an implantable circuit).

In some embodiments of the present disclosure, the electronic device may be a home appliance. The home appliance may include at least one of a television (TV), a digital video/versatile disc (DVD) player, an audio, a refrigerator, an air conditioner, a cleaner, an oven, a microwave oven, a washing machine, an air cleaner, a set-top box, a home automation control panel, a security control panel, a TV box (e.g., Samsung HomeSync™, Apple TV™, or Google TV™), a game console (e.g., Xbox™ or PlayStation™), an electronic dictionary, an electronic key, a camcorder, or an electronic picture frame.

In other embodiments of the present disclosure, the electronic device may include at least one of a medical device (e.g., a portable medical measurement device (e.g., a blood glucose measuring device, a heart rate measuring device, a blood pressure measuring device, a body temperature measuring device, or the like), a magnetic resonance angiography (MRA) device, a magnetic resonance imaging (MRI) device, a computed tomography (CT) device, a scanner, an ultrasonic device, or the like), a navigation device, a global navigation satellite system (GNSS), an event data recorder (EDR), a flight data recorder (FDR), a vehicle infotainment device, electronic equipment for vessels (e.g., a navigation system, a gyrocompass, or the like), avionics, a security device, a head unit for a vehicle, an industrial or home robot, an automatic teller machine (ATM), a point of sales (POS)

device, or an Internet of Things (IoT) device (e.g., a light bulb, a sensor, an electric or gas meter, a sprinkler, a fire alarm, a thermostat, a streetlamp, a toaster, an exercise equipment, a hot water tank, a heater, a boiler, or the like).

According to various embodiments of the present disclosure, the electronic device may include at least one of a part of furniture or a building/structure, an electronic board, an electronic signature receiving device, a projector, or a measuring instrument (e.g., a water meter, an electricity meter, a gas meter, a wave meter, or the like).

According to an embodiment of the present disclosure, the electronic device may be a flexible device.

The electronic device may be one or more combinations of the above-mentioned devices. The electronic device is not limited to the above-mentioned devices, and may include new electronic devices in accordance with the development of new technology.

The term "user" used herein may refer to a person who uses an electronic device or may refer to a device (e.g., an artificial intelligence electronic device) that uses the electronic device.

FIG. 1 is a perspective view of an electronic device including multiple antennas, according to an embodiment of the present disclosure.

Referring to FIG. 1, an electronic device 100 is provided. The electronic device 100 includes a housing 110 and a display 130.

The housing 110 includes a front surface, a rear surface, and a side surface surrounding a portion of a space between the front surface and the rear surface. The housing 110 may form an appearance of the electronic device 100. The housing 110 may fix and support at least one internal element (e.g., the display 130) of the electronic device 100.

According to an embodiment, the housing 110 includes a conductive member in at least one area thereof. For instance, the housing 110 may include a metal frame. The conductive member may be physically divided into a plurality of parts by at least one non-conductive member or a segment part, e.g., a first non-conductive member 111, a second non-conductive member 113, or a third non-conductive member 115. In FIG. 1, the first non-conductive member 111 is disposed at an upper end of a right side surface of the housing 110, the second non-conductive member 113 is disposed at a left end of a lower side surface, and the third non-conductive member 115 is disposed at a right end of the lower side surface, but the arrangements of the first, second, and third non-conductive members 111, 113, and 115 should not be limited thereto or thereby. For example, at least one other non-conductive member may further be disposed at an upper end of a left side surface of the housing 110. As another example, the non-conductive member may be disposed at left and right ends of an upper side surface of the housing 110. Further, the non-conductive member may be disposed in a direction substantially vertical to a front surface or a rear surface of the housing 110.

The electronic device 100 may include multiple antennas. For example, at least one antenna may be disposed in the housing 110. As another example, a portion of the conductive member disposed at at least one surface of the housing 110 may be used as the antenna. For instance, the parts of the conductive member, which are physically separated from each other by the first non-conductive member 111, may be used as the at least one antenna. In this case, the conductive member used as the antenna may be electrically connected to a communication module disposed in the housing 110.

The communication module establishes a communication between the electronic device 100 and an external electronic device. The communication module may be connected to a network through a wireless or wired communication network to communicate with the external electronic device.

The communication module connected to the antenna may include a circuit to transmit or receive a signal of a designated frequency band. For example, the communication module may include a transceiver, a power amplifier module (PAM), a frequency filter, or a low noise amplifier (LNA).

The wireless communication may include at least one of LTE, LTE-Advanced (LTE-A), code division multiple access (CDMA), wideband CDMA (WCDMA), universal mobile telecommunications system (UMTS), wireless broadband (WiBro), global system for mobile communications (GSM), or the like, as a cellular communication protocol. Furthermore, the wireless communication may include, for example, a local area network. The local area network may include at least one of WiFi, Bluetooth (BT), near field communication (NFC), magnetic stripe transmission (MST), or GNSS.

The MST may generate a pulse according to transmission data using an electromagnetic signal, and the pulse may generate a magnetic field signal. The electronic device 100 may transmit the magnetic field signal to a POS device, and the POS device may detect the magnetic field signal using an MST reader and convert the detected magnetic field signal to an electrical signal to restore data.

The GNSS may include at least one of, for example, GPS, Glonass (global navigation satellite system), Beidou navigation satellite system (Beidou), or Galileo, the European global satellite-based navigation system, depending on areas of use, bandwidth, etc. Hereinafter, GPS and GNSS may be interchangeably used in the following descriptions.

The wired communication may include at least one of a universal serial bus (USB), a high definition multimedia interface (HDMI), a recommended standard-232 (RS-232), or a plain old telephone service (POTS).

The network may include telecommunication networks, for example, at least one of a computer network (e.g., local area network (LAN) or wide area network (WAN)), an internet network, or a telephone network.

In the electronic device 100, a front case is coupled to the front surface of the housing 110. The front case may form a front appearance of the housing 110 and is coupled to the housing 110 to define the space in which the internal elements of the electronic device 100 are accommodated in the housing 110. At least a portion of the front case may be provided with a transparent material (e.g., a glass material), and a screen output through the display 130 may be displayed to the outside through the transparent area of the front case.

The display 130 displays various contents, e.g., a text, an image, a video, an icon, a symbol, etc., to a user. The display 130 may include, for example, a liquid crystal display (LCD), a light-emitting diode (LED) display, an organic LED (OLED) display, microelectromechanical systems (MEMS), or an electronic paper display. The display 130 may include a touch screen and receive, for example, a touch, gesture, proximity, or hovering input using an electronic pen or a portion of a user's body.

The configuration of the electronic device 100 should not be limited to the above-described configuration. The electronic device 100 may include at least one other component in addition to the above-described components. As an example, the electronic device 100 may include a processor, a memory, an input/output (I/O) interface, and the like. The at least one other component(s) may be mounted on a printed circuit board disposed in the housing 110.

The processor performs data processing or an operation associated with control or communication of at least one other component of the electronic device 100. The processor may drive an operating system (OS) or an application to control a plurality of hardware or software components connected to the processor and may process and compute a variety of data. The processor may include one or more of a CPU, an AP, or a communication processor (CP). The processor may be implemented with a System on Chip (SoC), for example.

The memory may store instructions or data associated with at least one other component of the electronic device 100. The memory may store software and/or a program. The memory may include a volatile and/or nonvolatile memory.

The I/O interface may transmit an instruction or data, input from the user or an external device, to another component of the electronic device 100. Furthermore, the I/O interface may output an instruction or data, received from another component of the electronic device 100, to the user or an external device.

Figure 2A:
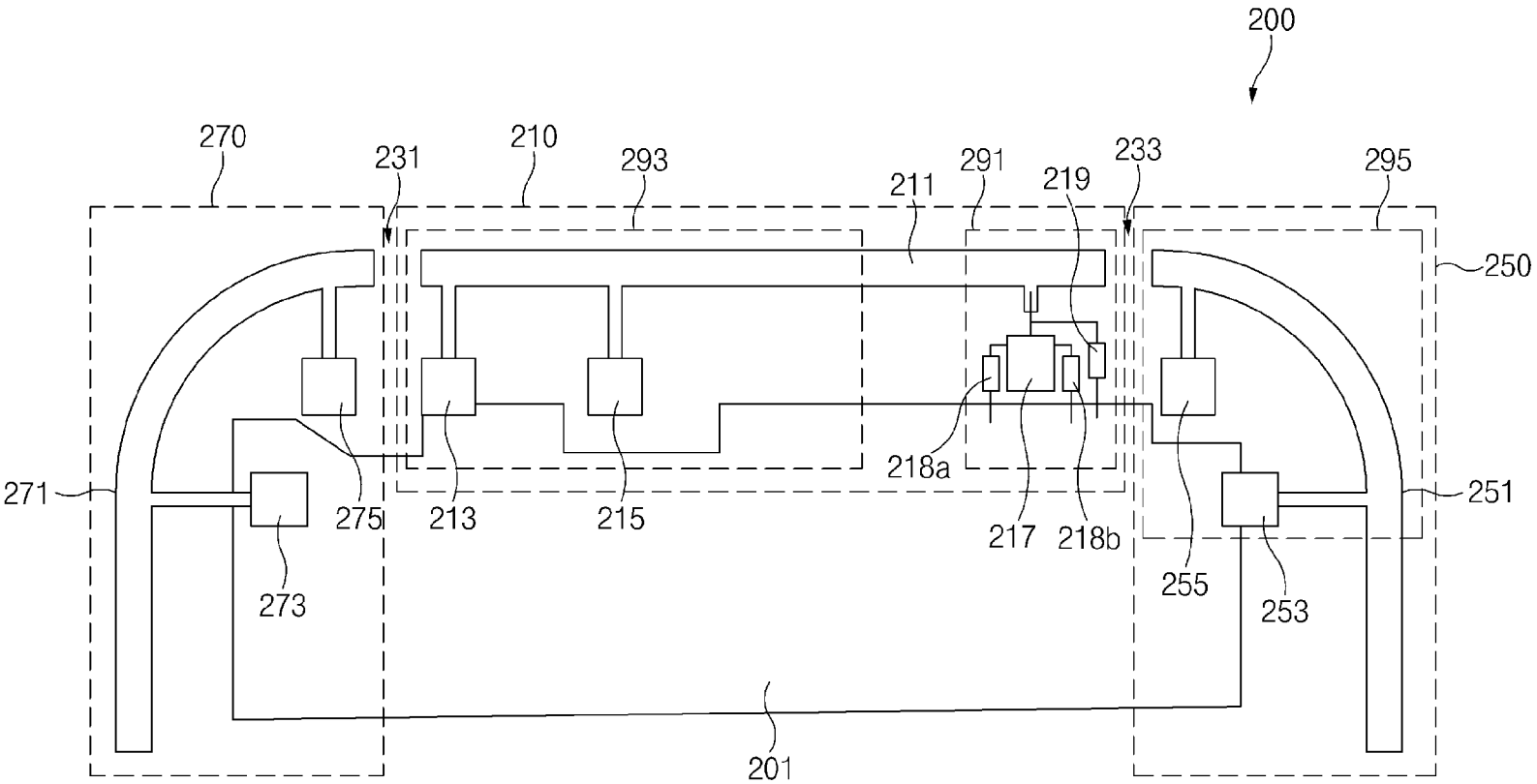
FIG. 2A is a view of an internal configuration of a portion of an electronic device including multiple antennas, according to an embodiment of the present disclosure.
Figure 2B:
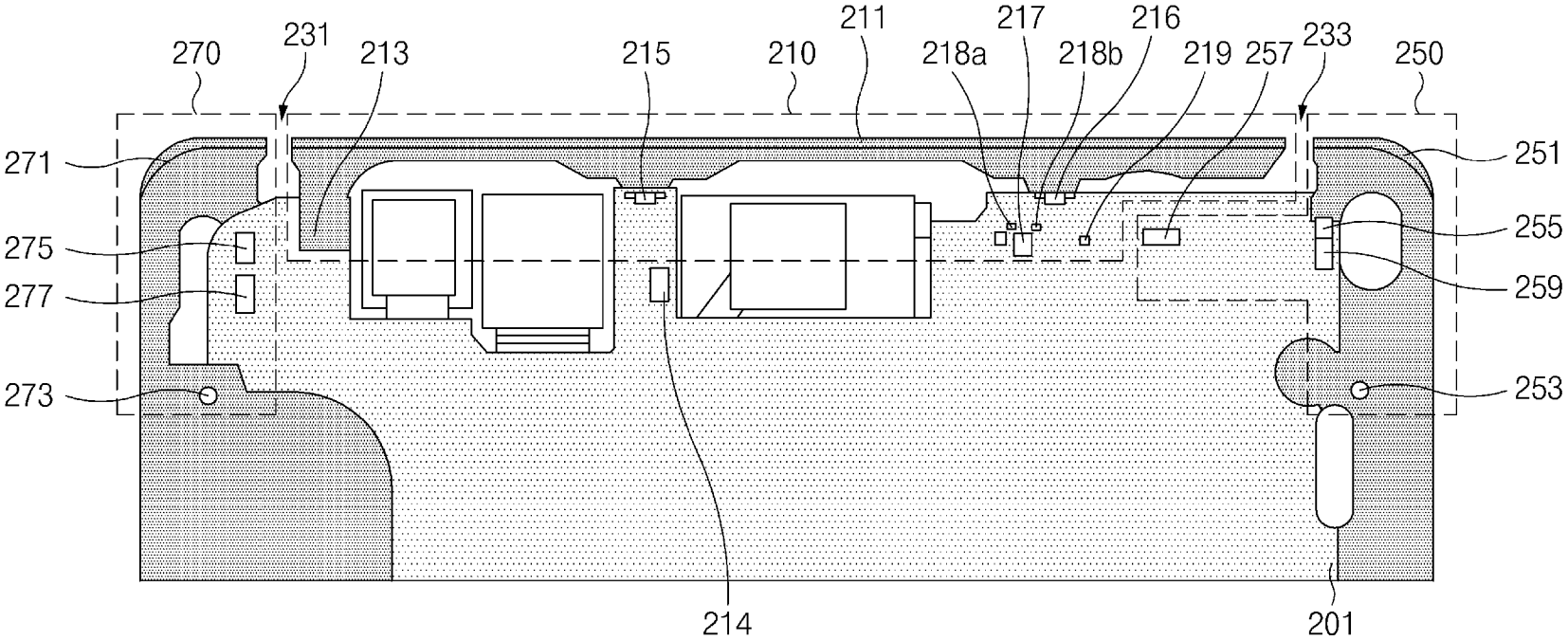
FIG. 2B is a view of an internal configuration of the electronic device of FIG. 2A, according to an embodiment of the present disclosure.

FIG. 2A is a view of an internal configuration of a portion of an electronic device including multiple antennas, according to an embodiment of the present disclosure; FIG. 2B is a view of an internal configuration of the electronic device of FIG. 2A, according to an embodiment of the present disclosure; and FIG. 2C is a view of a rear surface of the electronic device of FIG. 2A, according to an embodiment of the present disclosure.

Figure 2C:
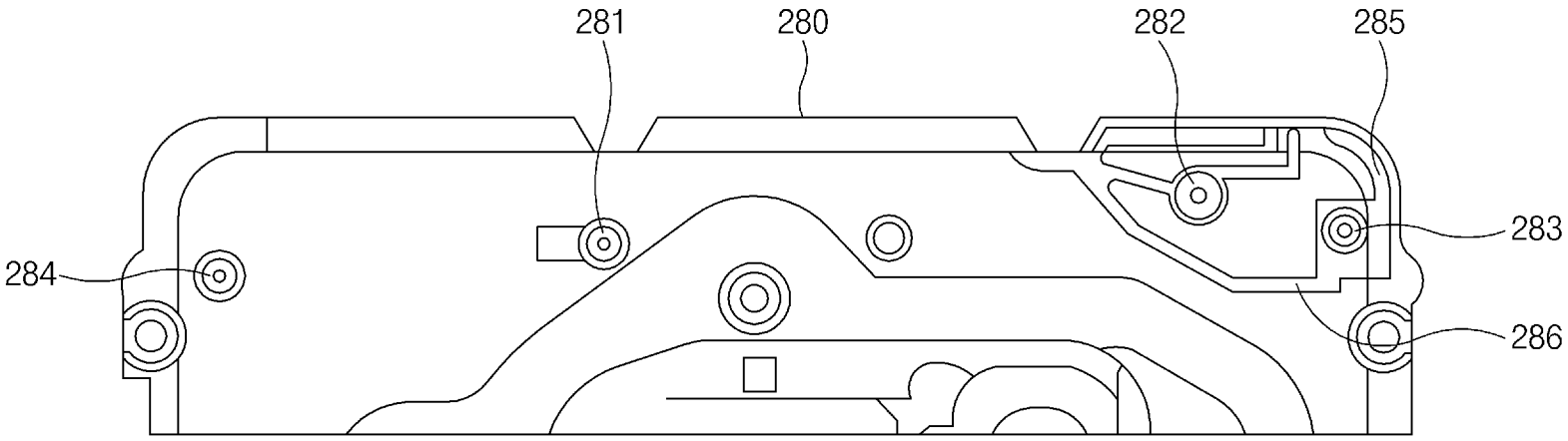
FIG. 2C is a view of a rear surface of the electronic device of FIG. 2A, according to an embodiment of the present disclosure.

Referring to FIGS. 2A to 2C, an electronic device 200 is provided. The electronic device 200 includes the multiple antennas, such as a first antenna 210, a second antenna 250, and a third antenna 270. For instance, the first antenna 210 is disposed at a center portion of an upper end of the electronic device 200, the second antenna 250 is disposed at a right portion of the upper end of the electronic device 200, and the third antenna 270 is disposed at a left portion of the upper end of the electronic device 200. However, the arrangements of the first, second, and third antennas 210, 250, and 270 are not be limited thereto.

The first antenna 210 and the third antenna 270 are physically separated from each other by a first segment part 231, and the first antenna 210 and the second antenna 250 are physically separated from each other by a second segment part 233. The first segment part 231 and the second segment part 233 may be a non-conductive member. As an example, the first segment part 231 and the second segment part 233 may be the non-conductive member included in the housing 110 of the electronic device 100.

The first antenna 210, the second antenna 250, or the third antenna 270 may include a radiator that transmits and receives a signal of a designated frequency band and a feeding part that connects a wireless communication circuit (e.g., a radio frequency (RF) circuit) to the radiator via a feeding line connected to the radiator. For instance, the feeding part may provide the radiator with an RF signal to allow the antennas 210, 250, and 270 to transmit and receive the signal of the designated frequency band. In addition, the antennas 210, 250, and 270 may be connected to a ground part through a ground line (or a conductive connection part). The first antenna 210 includes a first radiator 211, a first ground part 213, and a first feeding part 215. The second antenna 250 includes a second radiator 251, a second ground part 253, and a second feeding part 255. The third antenna 270 includes a third radiator 271, a third ground part 273, and a third feeding part 275. However, the antennas should not be limited to the above-described configuration. For example, at least one antenna among the antennas 210, 250, and 270 may not include the feeding part or the ground part.

The antennas 210, 250, and 270 may be connected to a ground area (or a ground layer or member) of a printed circuit board 201. For instance, the ground layer (e.g., a conductive member) may be provided on the printed circuit board 201, and the ground part may be formed in the ground layer.

The first antenna 210 may transmit and receive a signal of a low frequency band. The second antenna 250 may transmit and receive a signal of a medium/high frequency band. The third antenna 270 may transmit and receive the signal of the medium/high frequency band. As an example, the first antenna 210 may transmit and receive an LTE low-band (LB) signal (e.g., about 600 MHz to about 990 MHz). As another example, the second antenna 250 may transmit and receive a WiFi signal (e.g., about 2.4 GHz to about 5.0 GHz). As another example, the third antenna 270 may transmit and receive a GPS signal (e.g., about 1.2 GHz to about 1.5 GHz) and an LTE mid-band/high-band (MB/HB) signal (e.g., about 1.4 GHz to about 2.2 GHz or about 2.2 GHz to about 2.7 GHz).

At least one antenna of the first antenna 210, the second antenna 250, or the third antenna 270 may further include an additional radiator on a surface, such as a rear cover 280 of the electronic device 200 to transmit and receive a corresponding frequency band. As an example, as shown in FIGS. 2B and 2C, the first antenna 210 may be connected to a first connection part 281 disposed on the rear cover 280 of the electronic device 200 through a first connection terminal 214. As another example, the second antenna 250 may be connected to a second connection part 282 and a third connection part 283, which are disposed on the rear cover 280 of the electronic device 200, respectively through a second connection terminal 257 and a third connection terminal 259. As another example, the third antenna 270 may be connected to a fourth connection part 284 disposed on the rear cover 280 of the electronic device 200 through a fourth connection terminal 277.

In FIG. 2C, the second antenna 250 may further include a fourth radiator, such as a first conductive line 285 and a fifth radiator, such as a second conductive line 286, which are disposed on the rear cover 280 of the electronic device 200, but it should not be limited thereto or thereby. For example, at least one of the first antenna 210 or the third antenna 270 may further include an additional radiator. In addition, one of the fourth radiator, e.g., the first conductive line 285, and the fifth radiator, e.g., the second conductive line 286, of the second antenna 250 may be omitted or the second antenna 250 may further include another radiator in addition to the fourth radiator and the fifth radiator.

At least one of the above-described radiators may be formed on the housing 110 or the rear cover 280 of the electronic device 200 as a print type. For instance, at least one of the above-described radiators may be formed on the housing or the rear cover 280 of the electronic device 200 by a laser direct structure (LDS) manner.

The first antenna 210 is implemented to transmit and receive signals of multiple frequency bands. As shown in FIGS. 2A and 2B, a switching circuit 217 is connected to one end of the first radiator 211 of the first antenna 210. The first antenna 210 may be selectively connected to one of a plurality of frequency band elements, such as a first frequency band element 218*a* and a second frequency band element 218*b*, connected to the switching circuit 217 due to a switching operation of the switching circuit 217.

A first end of each of the frequency band elements 218*a* and 218*b* is connected to the switching circuit 217, and a second end of each of the frequency band elements 218*a* and 218*b* is connected to the ground area. As an example, the second end of each of the frequency band elements 218*a* and 218*b* is connected to the ground area (e.g., the conductive member) of the printed circuit board 201.

The frequency band elements 218*a* and 218*b* may be connected to the first radiator 211 such that the first antenna 210 transmits and receives the signal of the designated frequency band. As an example, the first radiator 211 may be connected to the first frequency band element 218*a* through the switching operation of the switching circuit 217 to transmit and receive a signal of a first frequency band (e.g., LTE B12 (700 MHz)) and may be connected to the second frequency band element 218*b* through the switching operation of the switching circuit 217 to transmit and receive a signal of a second frequency band (e.g., LTE B5 (850 MHz)).

FIGS. 2A and 2B show only the first frequency band element 218*a* and the second frequency band element 218*b*, but the number of the frequency band elements should not be limited to two. The first antenna 210 may further include at least one other frequency band element so as to transmit and receive signals in more frequency bands. For instance, the first antenna 210 may be connected to a third frequency band element by the switching operation of the switching circuit 217 to transmit and receive a signal (e.g., LTE B8 (900 MHz)) of a third frequency band.

The frequency band elements 218*a* and 218*b* may include at least one inductance element or at least one capacitance element. As an example, the frequency band element may be implemented by one component in the above-described description, but it should not be limited thereto or thereby. For example, a circuit implemented by a plurality of elements (e.g., at least one inductance element and at least one capacitance element) may be used to perform the same or a similar function as that of the frequency band element.

The first antenna 210 may include at least one isolation element (or an isolation circuit) disposed in an area adjacent to another antenna. As shown in FIGS. 2A and 2B, the first antenna 210 includes an isolation element 219 disposed in the area adjacent to the second antenna 250. One end of the isolation element 219 is connected to one end of the first radiator 211 in an area adjacent to the second radiator 251, and the other end of the isolation element 219 is connected to the ground area. The first radiator 211 is connected to at least one of the switching circuit 217 and the isolation element 219 through a connection part 216.

The isolation element 219 (or the isolation circuit) includes at least one capacitance element or at least one inductance element. When the isolation element 219 includes the capacitance element, the isolation element 219 may have high impedance characteristics in the low frequency band and may have low impedance characteristics in the medium/high frequency bands. Accordingly, when the first antenna 210 receives the signal of the low frequency band, the isolation element 219 is operated as an open circuit due to the high impedance characteristics thereof. In addition, when the second antenna 250 disposed adjacent to the first antenna 210 receives the signal of the medium/high frequency bands, the isolation element 219 is operated as a short circuit due to the low impedance characteristics thereof. Consequently, the first antenna 210 may not be affected by the isolation element 219, and the second antenna 250 may be isolated by the isolation element 219 connected to the ground area, thereby improving a performance of the antenna.

When the isolation element 219 includes the capacitance element and the inductance element, the isolation element 219 may have the low impedance characteristics at a certain frequency band because of a phenomenon in which the antenna is electrically resonated at the certain frequency band (e.g., a resonant frequency band) determined by a capacitance value of the capacitance element and an inductance value of the inductance element and may have the high impedance characteristics at other frequency bands except for the certain frequency band. Accordingly, the first antenna 210 that transmits and receives a signal of the other frequency bands, except for the certain frequency band, may not be affected by the isolation element 219, and the second antenna 250 that transmits and receives the signal of the certain frequency band may be isolated by the isolation element 219 connected to the ground area, thereby improving a performance of the antenna.

The second antenna 250 may be implemented to transmit and receive the signals of multiple frequency bands. As an example, the second antenna 250 may selectively transmit and receive a signal of a third frequency band (e.g., about 2.4 GHz) or a signal of a fourth frequency band (e.g., about 5.0 GHz) by the communication module connected to the second antenna 250. As shown in FIG. 2C, the second antenna 250 may transmit and receive signals of different frequency bands from each other by adjusting a length of the first conductive line 285 and the second conductive line 286 connecting the communication module and the second radiator 251. For instance, the first conductive line 285 and the second conductive line 286 connecting the communication module and the second radiator 251 may have different lengths. That is, the first conductive line 285 may have a first length and the second conductive line 286 may have a second length. At least one of the first conductive line 285 or the second conductive line 286 may include a conductive pattern.

The first antenna 210 may include at least one other isolation element disposed in an area adjacent to the third antenna 270. For instance, one end of the at least one other isolation element may be connected to the one end of the first radiator 211 in an area adjacent to the third radiator 271, and the other end of the at least one other isolation element may be connected to the ground area. In this case, the third antenna 270 may be isolated by the at least one other isolation element, and thus a performance of the third antenna 270 may be improved.

Additionally, at least one of the antennas 210, 250, and 270 may be connected to a matching circuit. The matching circuit is an electrical circuit having a predetermined impedance and may correct a difference in impedance between two connection points connected to the matching circuit. The matching circuit may include, for example, at least one capacitance element or at least one inductance element.

Figure 3:
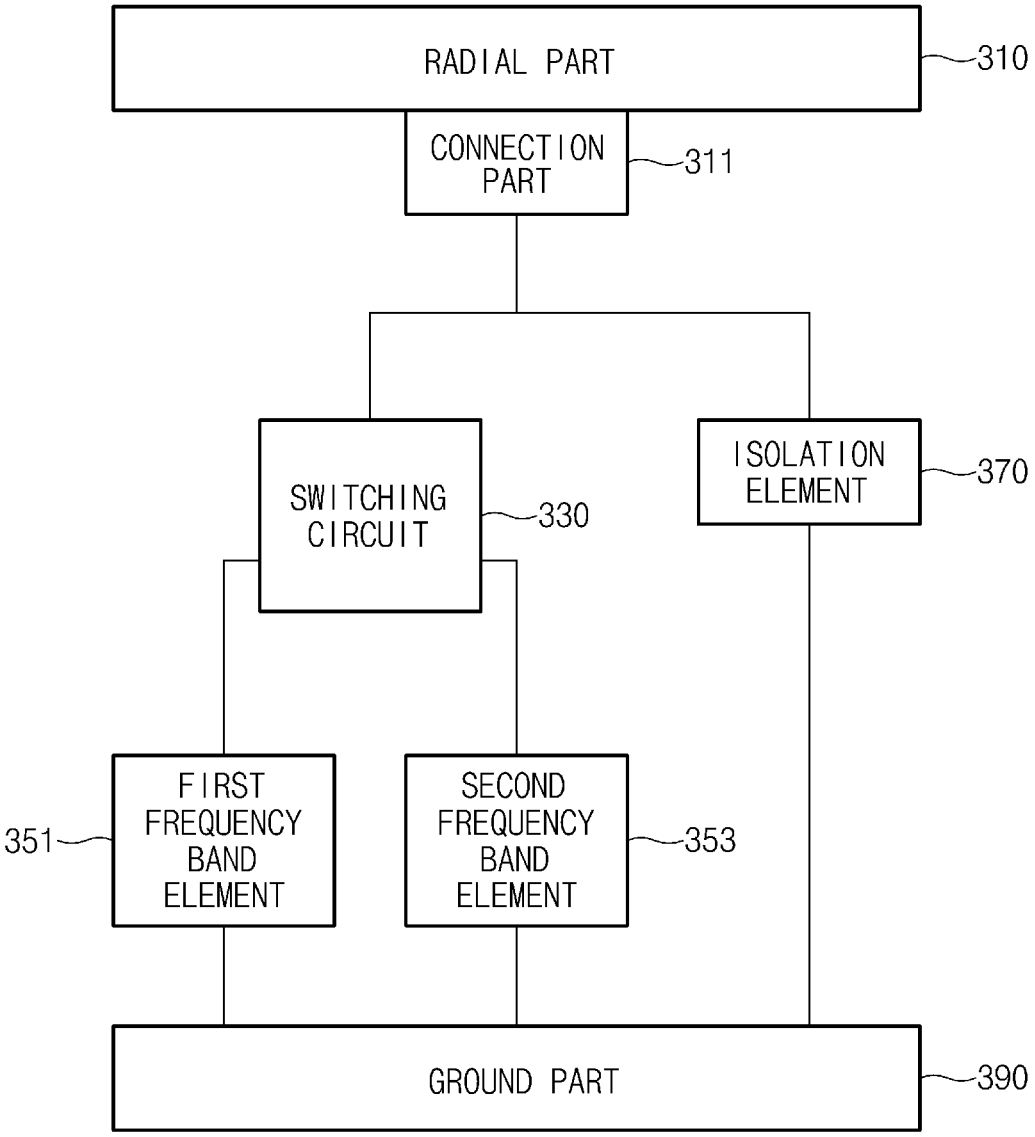
FIG. 3 is a block diagram of elements disposed at one end of an antenna that supports transmission and reception signals of multiple frequency bands, according to an embodiment of the present disclosure.

FIG. 3 is a block diagram of elements disposed at one end of an antenna that supports transmission and reception signals of multiple frequency bands, according to an embodiment of the present disclosure.

Referring to FIG. 3, the elements shown correspond to elements arranged in a first area 291 of the first antenna 210, shown in FIGS. 2A to 2C. Accordingly, the first antenna 210 includes a radial part 310, a connection part 311, a switching circuit 330, a first frequency band element 351, a second frequency band element 353, an isolation element 370, and a ground part 390 is arranged at one end of an antenna that transmits and receives signals of multiple frequency bands.

The radial part 310 may be connected to the first frequency band element 351 or the second frequency band element 353 to serve as a radiator (e.g., the first radiator 211) that transmits and receives the signal of the first frequency band or the second frequency band. The radial part 310 may be formed of a conductive material. As an example, the radial part 310 may be formed by a portion of the conductive member (e.g., the metal frame) included in the housing (e.g., the housing 110) of the electronic device (e.g., the electronic device 100).

The radial part 310 is connected to the switching circuit 330 through the connection part 311. The connection part 311 may be a conductive member. The connection part 311 may be a C-clip. As an example, the connection part 311 may be engaged with one side portion of the metal frame to electrically connect the radial part 310 and the switching circuit 330.

The switching circuit 330 allows the radial part 310 to be selectively connected to the frequency band element connected to the switching circuit 330. For instance, the switching circuit 330 may perform the switching operation such that the radial part 310 is connected to the first frequency band element 351 or the second frequency band element 353.

The first frequency band element 351 or the second frequency band element 353 may be connected to the radial part 310 to transmit and receive the signals of the first frequency band or the second frequency band. One end of the first frequency band element 351 or the second frequency band element 353 may be connected to the switching circuit 330, and the other end of the first frequency band element 351 or the second frequency band element 353 may be connected to the ground part 390. FIG. 3 shows only the first frequency band element 351 and the second frequency band element 353, but the number of the frequency band elements should not be limited to two. For example, at least one other frequency band element may be connected to the switching circuit 330. The frequency band elements 351 and 353 may include at least one inductance element or at least one capacitance element.

The isolation element 370 is connected to one end of the radial part 310. The isolation element 370 is connected to the radial part 310 through the connection part 311. One end of the isolation element 370 is connected to the radial part 310, and the other end of the isolation element 370 is connected to the ground part 390. The isolation element 370 includes at least one capacitance element or at least one inductance element. The isolation element 370 may be disposed in an area adjacent to another antenna (e.g., the second antenna) to secure an isolation for the other antenna. In the case that the isolation element 370 is disposed in the area adjacent to the other antenna, the other antenna may be isolated by the isolation element 370 connected to the ground part 390, and thus a performance of the other antenna may be improved. As an example, in the case that the isolation element 370 includes the capacitance element, the isolation element 370 is operated as the short circuit since the isolation element 370 has the low impedance characteristics in the medium/high frequency bands. Accordingly, the another antenna that transmits and receives the signal of the medium/high frequency bands may have an effect in which, due to the isolation element 370 connected to the ground part 390, the ground area expands. As another example, in the case that the isolation element 370 includes the capacitance element and the inductance element, the isolation element 370 may be operated as the short circuit since the isolation element 370 has the low impedance characteristics in the certain frequency band. Accordingly, the other antenna that transmits and receives the signal of the certain frequency band may have an effect in which, due to the isolation element 370 connected to the ground part 390, the ground area expands.

The ground part 390 is connected to the ground area. As an example, the ground part 390 is connected to the ground area (e.g., the ground layer) of the printed circuit board 201 disposed in the electronic device 200. For instance, the ground layer (e.g., the conductive member) is provided on the printed circuit board, and the ground part 390 is formed in the ground layer. The ground part 390 is connected to the conductive member included in the housing of the electronic device. For instance, a portion of the conductive member included in the housing 110 of the electronic device 100 may provide the ground area, and the ground part 390 may be connected to the conductive member.

Figure 4:
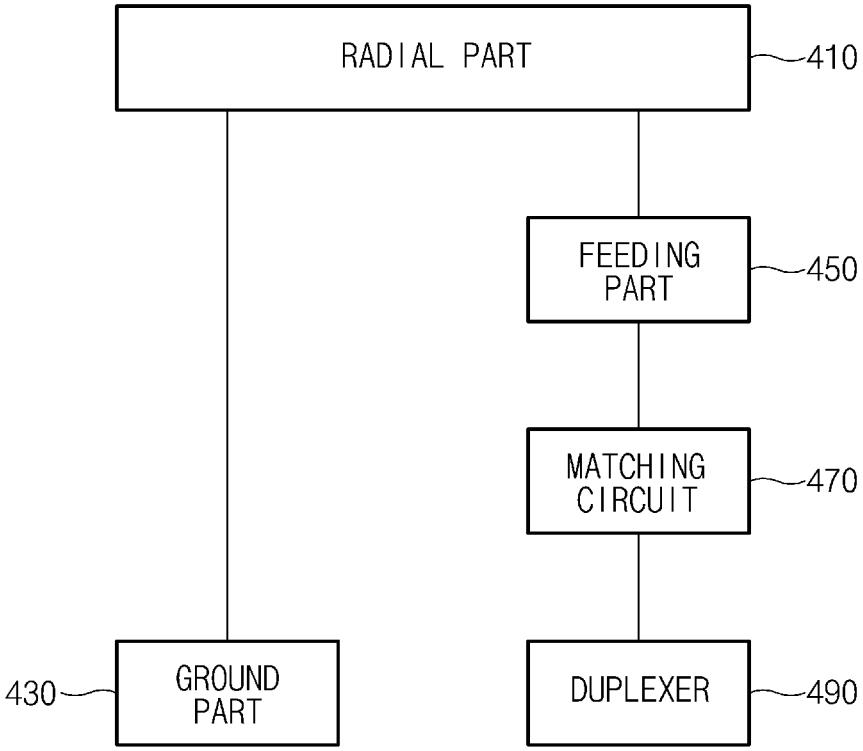
FIG. 4 is a block diagram of elements disposed at the other end of the antenna shown in FIG. 3, according to an embodiment of the present disclosure.

FIG. 4 is a block diagram showing elements disposed at the other end of the antenna shown in FIG. 3.

Referring to FIG. 4, the elements shown correspond to elements arranged in a second area 293 of the first antenna 210 or a third area 295 of the second antenna 250, shown in FIGS. 2A to 2C. An antenna that transmits and receives signals of multiple frequency bands includes a radial part 410, a ground part 430, a feeding part 450, a matching circuit 470, and a duplexer 490. At least some of the above-described elements may be substantially the same as at least some of the elements shown in FIG. 3. For instance, the radial part 410 may be substantially the same as the radial part 310 of FIG. 3, and the ground part 430 may be substantially the same as the ground part 390 of FIG. 3, but they should not be limited thereto or thereby.

The radial part 410 may include a conductive member physically separated from the radial part 310. In this case, the radial part 410 and the radial part 310 may be disposed adjacent to each other and coupled to each other. In addition, the ground part 430 may be connected to a conductive member different from and physically separated from the conductive member to which the ground part 390 is connected. The ground part 430 and the ground part 390 may be physically separated from each other but electrically connected to each other. For instance, the ground part 430 may be connected to a conductive member of a first printed circuit board disposed in the electronic device 100, and the ground part 390 may be connected to a conductive member of a second printed circuit board disposed in the electronic device 100 or a conductive member of the housing 110.

The feeding part 450 is connected to the radial part 410 to connect an RF circuit to the radial part 410. The feeding part 450 may be connected to a communication module disposed in the electronic device to transmit a signal (e.g., an RF signal) of a designated frequency band to the radial part 410.

The matching circuit 470 may correct a difference in impedance between two connection terminals connected to the matching circuit 470. The matching circuit 470 may include, for example, at least one capacitance element or at least one inductance element. One end of the matching circuit 470 may be connected to the feeding part 450, and the other end of the matching circuit 470 may be connected to the duplexer 490.

The duplexer 490 may separate a signal transmitted and received through the radial part 410. As an example, the duplexer 490 may separate a transmission signal and a reception signal from each other, and thus the duplexer 490 may support transmission and reception of the signal through one radial part 410.

The arrangement of the feeding part 450, the matching circuit 470, and the duplexer 490 may be varied. As an example, one end of the duplexer 490 may be connected to the radial part 410, and the other end of the duplexer 490 may be connected to the feeding part 450. As another example, one end of the matching circuit 470 may be connected to the radial part 410, and the other end of the matching circuit 470 may be connected to the feeding part 450.

As described above, according to various embodiments, an electronic device including a plurality of antennas includes a first antenna (e.g., the first antenna 210) configured to transmit and receive signals of a plurality of frequency bands, and a second antenna (e.g., the second antenna 250) configured to be disposed at an area adjacent to the first antenna. The first antenna includes a first wireless communication circuit, a first radiator (e.g., the first radiator 211), a first feeding part (the first feeding part 215) configured to connect the first wireless communication circuit to the first radiator, a first ground part (e.g., the first ground part 213) configured to be connected to one end of the first radiator, a switching circuit (e.g., the switching circuit 217) configured to be connected to the first radiator in an area adjacent to the second antenna, at least one frequency band element (e.g., the first frequency band element 218*a* or the second frequency band element 218*b*) in which one end thereof is connected to the switching circuit and the other end thereof is connected to the first ground part, and at least one isolation element (e.g., the isolation element 219) configured to connect the first radiator to the ground part in the area adjacent to the second antenna.

The at least one frequency band element includes at least one capacitance element or at least one inductance element.

The first radiator is configured to be selectively connected to the at least one frequency band element according to a switching operation of the switching circuit and configured to transmit and receive a signal of a frequency band having a frequency range from 600 MHz to 990 MHz.

The at least one isolation element includes at least one capacitance element or at least one inductance element.

The first radiator is configured to be connected to at least one of the switching circuit or the at least one isolation element through a connection part (e.g., the connection part 216).

The connection part includes a C-clip.

The electronic device may further include a matching circuit (e.g., the matching circuit 470) having a predetermined impedance. The matching circuit is configured to be connected to one end of the first feeding part.

The matching circuit includes at least one capacitance element or at least one inductance element.

The electronic device may further include a duplexer (e.g., the duplexer 490) configured to separate a signal transmitted and received through the first radiator. The duplexer is configured to be connected to one end of the first feeding part.

The second antenna includes a second wireless communication circuit, a second radiator (e.g., the second radiator 251), a second feeding part (e.g., the second feeding part 255) configured to connect the second wireless communication circuit to the second radiator, a second ground part (e.g., the second ground part 253) connected to one end of the second radiator, and a plurality of matching circuits each in which one end thereof is connected to the second feeding part and the other end thereof is connected to the second radiator.

Each of the matching circuits includes at least one capacitance element or at least one inductance element.

The matching circuits include conductive lines to connect the second feeding part and the second radiator, and the conductive lines are configured to have different lengths.

According to various embodiments, the electronic device includes a housing configured to comprise a first surface facing a first direction, a second surface facing a second direction opposite to the first direction, and a side surface surrounding at least a portion of a space between the first surface and the second surface, a first conductive member configured to be included in the housing and/or to form a portion of the housing, a ground member configured to be included in the housing, a switching circuit configured to comprise a first terminal, a second terminal, and a third terminal, the first terminal being configured to be electrically connected to a first point of the first conductive member, a first circuit configured to be electrically connected between the second terminal of the switching circuit and the ground member and to comprise at least one of a capacitance element or an inductance element, a second circuit configured to be electrically connected between the third terminal of the switching circuit and the ground member and to comprise at least one of a capacitance element or an inductance element, a third circuit configured to comprise at least one of a capacitance element or an inductance element, which is electrically connected to the first point of the first conductive member, the first terminal of the switching circuit, and the ground member, a first wireless communication circuit configured to be electrically connected to a second point spaced apart from the first point of the first conductive member, and a conductive connection part configured to electrically connect a third point spaced apart from the first point of the first conductive member and the ground member.

The first wireless communication circuit is configured to transmit and/or receive a signal of a first frequency band having a frequency range from 600 MHz to 990 MHz.

The electronic device may further include a second conductive member disposed in the vicinity of one end of the first conductive member and spaced apart from the first conductive member. The first point of the first conductive member is closer to the second conductive member than the second point.

The electronic device may further include a second wireless communication circuit electrically connected to the second conductive member. The second wireless communication circuit is configured to transmit and/or receive a signal of a second frequency band that is at least partly different from the first frequency band.

The electronic device may further include a non-conductive member. The first conductive member and the second conductive member are configured to form at least a portion of the side surface of the housing, and the non-conductive member is disposed between the first conductive member and the second conductive member.

The electronic device may further include a third conductive member disposed at an opposite position to the second conductive member with respect to the first conductive member. The third point of the first conductive member is closer to the third conductive member than the second point.

The electronic device may further include a non-conductive member. The third conductive member is configured to form at least one other portion of the side surface of the housing, and the non-conductive member is disposed between the first conductive member and the third conductive member.

The second point of the first conductive member is placed between the third point and the first point.

Figure 5:
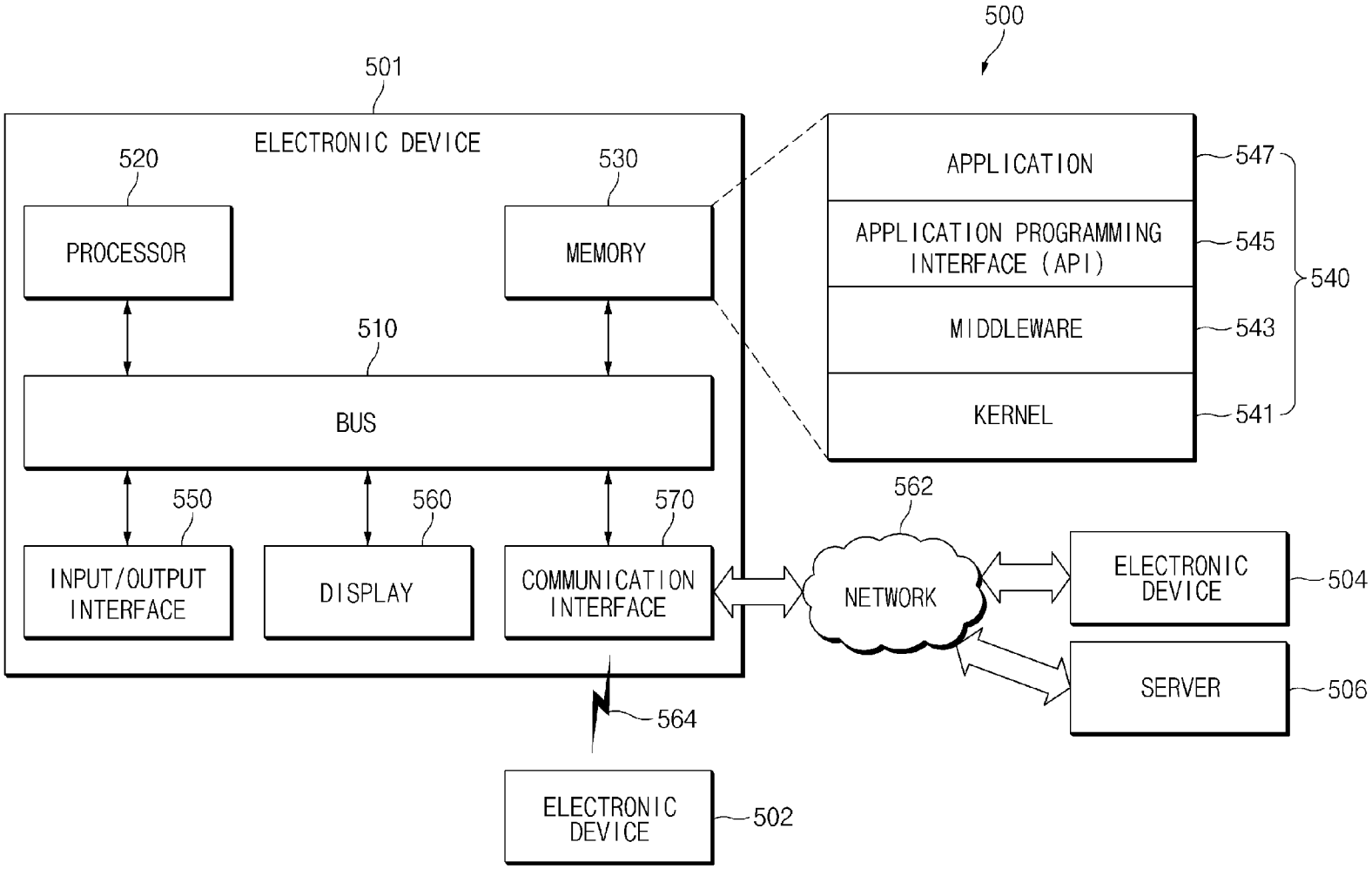
FIG. 5 is a block diagram of an electronic device in a network environment, according to an embodiment of the present disclosure.

FIG. 5 is a block diagram of an electronic device in a network environment, according to an embodiment of the present disclosure.

Referring to FIG. 5, an electronic device 501 in a network environment 500 is provided. The electronic device 501 includes a bus 510, a processor 520, a memory 530, an I/O interface 550, a display 560, and a communication interface 570. In various embodiments of the present disclosure, at least one of the foregoing elements may be omitted or another element may be added to the electronic device 501.

The bus 510 is a circuit for connecting the above-mentioned elements 510 to 570 to each other and transferring communications (e.g., control messages and/or data) among the above-mentioned elements.

The processor 520 includes at least one of a CPU, an AP, or a CP. The processor 520 performs data processing or an operation related to communication and/or control of at least one of the other elements of the electronic device 501.

The memory 530 may include a volatile memory and/or a nonvolatile memory. The memory 530 stores instructions or data related to at least one of the other elements of the electronic device 501. The memory 530 may store software and/or a program 540. The program 540 may include a kernel 541, a middleware 543, an application programming interface (API) 545, and/or an application 547. At least a portion of the kernel 541, the middleware 543, or the API 545 may be referred to as an OS.

The kernel 541 controls or manages system resources (e.g., the bus 510, the processor 520, the memory 530, or the like) used to perform operations or functions of other programs (e.g., the middleware 543, the API 545, or the application 547). Furthermore, the kernel 541 may provide an interface for allowing the middleware 543, the API 545, or the application 547 to access individual elements of the electronic device 501 in order to control or manage the system resources.

The middleware 543 serves as an intermediary so that the API 545 or the application 547 communicates and exchanges data with the kernel 541.

Furthermore, the middleware 543 handles one or more task requests received from the application 547 according to a priority order. For example, the middleware 543 may assign at least one application 547 a priority for using the system resources (e.g., the bus 510, the processor 520, the memory 530, or the like) of the electronic device 501. For example, the middleware 543 may handle the one or more task requests according to the priority assigned to the at least one application 547, thereby performing scheduling or load balancing with respect to the one or more task requests.

The API 545, which is an interface for allowing the application 547 to control a function provided by the kernel 541 or the middleware 543, may include, for example, at least one interface or function (e.g., instructions) for file control, window control, image processing, character control, or the like.

The I/O interface 550 serves to transfer an instruction or data input from a user or another external device to another element of the electronic device 501. Furthermore, the I/O interface 550 may output instructions or data received from another element of the electronic device 501 to the user or another external device.

The display 560 may include, for example, an LCD, an LED display, an OLED display, a MEMS display, or an electronic paper display. The display 560 may present various content (e.g., a text, an image, a video, an icon, a symbol, or the like) to the user. The display 560 may include a touch screen, and may receive a touch, gesture, proximity or hovering input from an electronic pen or a part of a body of the user.

The communication interface 570 sets communications between the electronic device 501 and a first external electronic device 502, a second external electronic device 504, or a server 506. For example, the communication interface 570 may be connected to short-range communication 564 to communicate with the first external electronic device 502 and may be connected to a network 562 via wireless communications or wired communications to communicate with the second external electronic device 504 or the server 506.

The wireless communications may employ at least one of cellular communication protocols such as LTE, LTE-A, CDMA, WCDMA, UMTS, WiBro, or GSM. The wireless communications may include the short-range communications 564. The short-range communications 564 may include at least one of Wi-Fi, BT, NFC, MST, or GNSS.

The MST may generate pulses according to transmission data and the pulses may generate electromagnetic signals. The electronic device 501 may transmit the electromagnetic signals to a reader device such as a POS device. The POS device may detect the magnetic signals by using a MST reader and restore data by converting the detected electromagnetic signals into electrical signals.

The GNSS may include at least one of GPS, GLONASS, BeiDou, or Galileo according to a use area or a bandwidth. The wired communications may include at least one of USB, a HDMI) a RS-232, a POTS, or the like. The network 562 may include at least one of telecommunications networks, for example, a computer network (e.g., LAN or WAN), the Internet, or a telephone network.

The types of the first external electronic device 502 and the second external electronic device 504 may be the same as or different from the type of the electronic device 501. The server 506 may include a group of one or more servers. A portion or all of operations performed in the electronic device 501 may be performed in one or more other electronic devices, such as the first electronic device 502, the second external electronic device 504, or the server 506. When the electronic device 501 should perform a certain function or service automatically or in response to a request, the electronic device 501 may request at least a portion of functions related to the function or service from another device instead of or in addition to performing the function or service for itself. The other electronic device may perform the requested function or additional function, and may transfer a result of the performance to the electronic device 501. The electronic device 501 may use a received result itself or additionally process the received result to provide the requested function or service. To this end, for example, a cloud computing technology, a distributed computing technology, or a client-server computing technology may be used.

Figure 6:
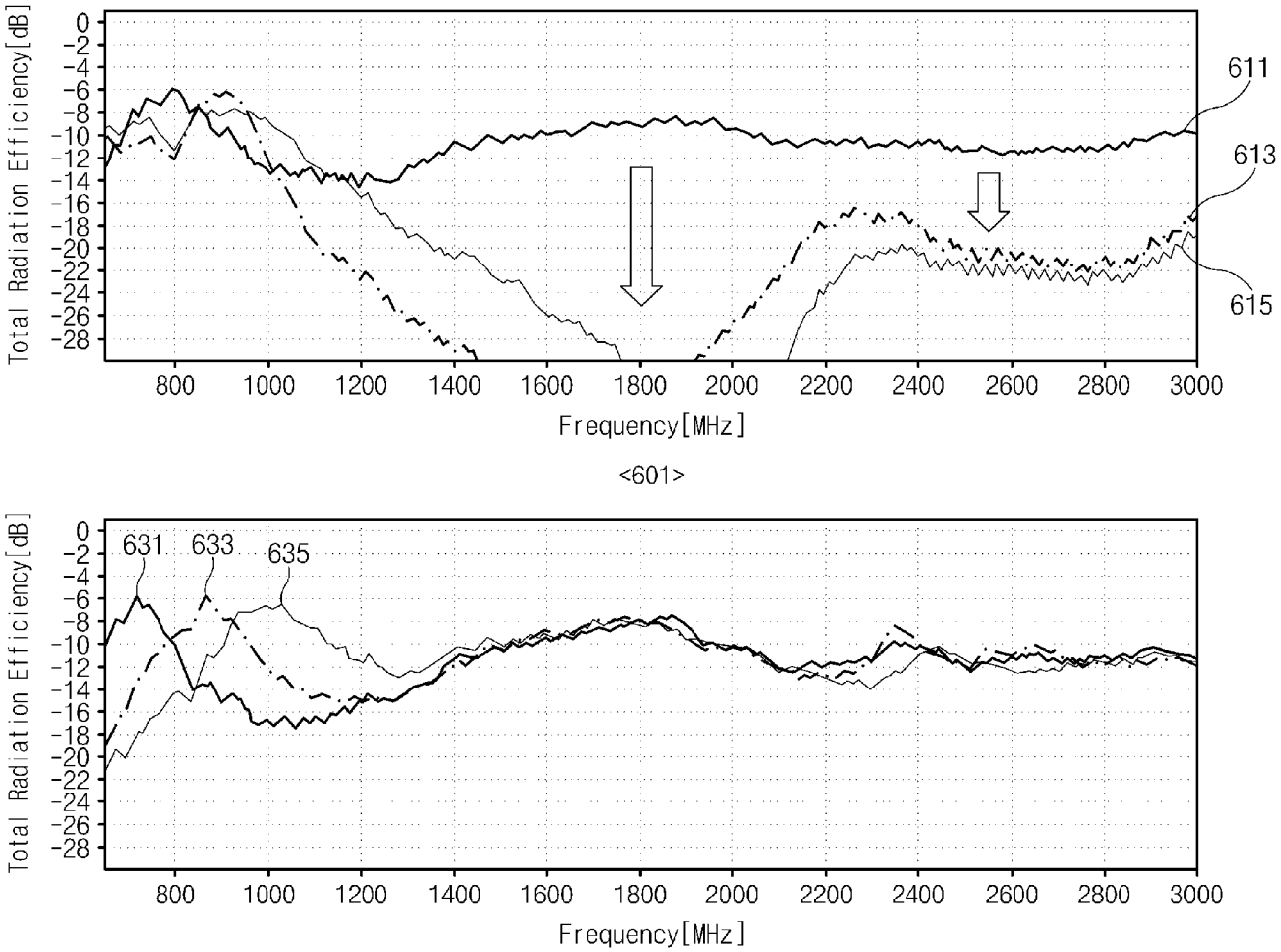
FIG. 6 illustrates graphs of radiation efficiency of a first antenna, according to an embodiment of the present disclosure.
Figure 7:
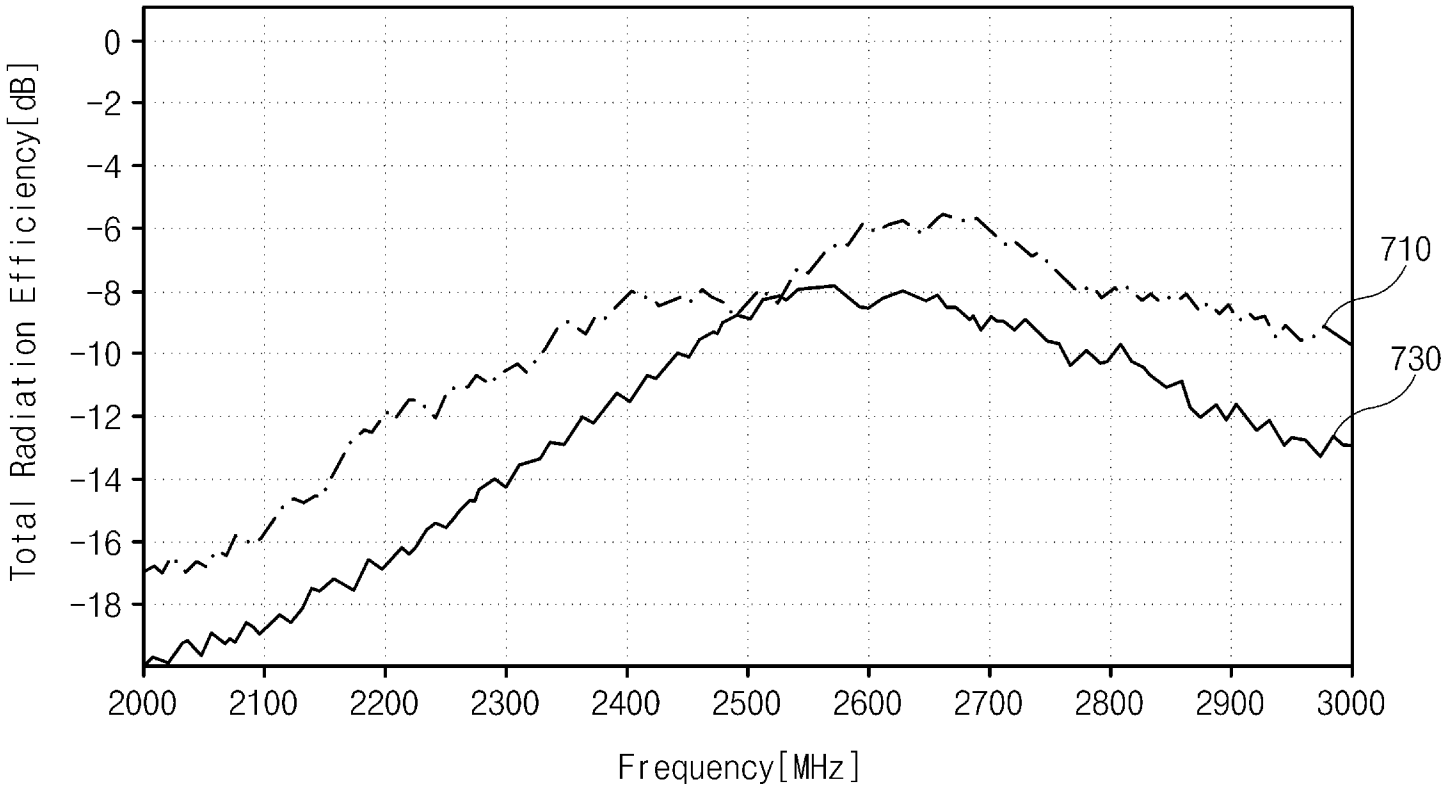
FIG. 7 is a graph of radiation efficiency of a second antenna, according to an embodiment of the present disclosure.

FIG. 6 illustrates graphs of radiation efficiency of a first antenna, according to an embodiment of the present disclosure and FIG. 7 is a graph of radiation efficiency of a second antenna, according to an embodiment of the present disclosure.

Referring to FIGS. 6 and 7, the graphs shown therein represent a ratio between a power of a radio wave radiated from the antenna and a power provided to the antenna.

Referring to FIG. 6, a first graph 601 and second graph 603 are provided. The first antenna 210, in which the isolation element 219 is disposed in the area adjacent to the second antenna 250, may transmit and receive the signals of multiple frequency bands. The first antenna 210 may selectively connect the frequency band elements 218*a* and 218*b* connected to the switching circuit 217 to the first radiator 211 of the first antenna 210 through the switching operation of the switching circuit 217, and thus the first antenna 210 may transmit and receive the signals of the multiple frequency bands.

As shown in the first graph 601, the radiation efficiency of the first antenna 210 may be deteriorated at the certain frequency band during the switching operation of the switching circuit 217 in a state that the isolation element 219 is not disposed in the area adjacent to the second antenna 250. For instance, in the case of the first antenna 210, a radiation efficiency 613 in a state in which the first radiator 211 is connected to the second frequency band element 218*b* and a radiation efficiency 615 in a state in which the first radiator 211 is connected to a third frequency band element may be more deteriorated than a radiation efficiency 611 in a state in which the first radiator 211 is connected to the first frequency band element 218*a*. To settle this problem, the first antenna 210 includes the isolation element 219 disposed in the area adjacent to the second antenna 250.

As shown in the second graph 603, the radiation efficiency of the first antenna 210 may not be deteriorated at the certain frequency band during the switching operation of the switching circuit 217 in a state that the isolation element 219 is disposed in the area adjacent to the second antenna 250. For instance, in the case of the first antenna 210, a radiation efficiency 631 in a state in which the first radiator 211 is connected to the first frequency band element 218*a*, a radiation efficiency 633 in a state in which the first radiator 211 is connected to the second frequency band element 218*b*, and a radiation efficiency 635 in a state in which the first radiator 211 is connected to the third frequency band element may not be deteriorated.

Referring to FIG. 7, when the first antenna 201 does not include the isolation element 219 in the area adjacent to the second antenna 250, the second antenna 250 may not be isolated enough. As shown in FIG. 7, in the case of the second antenna 250, a radiation efficiency 710 in a case that the first antenna 210 includes the isolation element 219 disposed in the area adjacent to the second antenna 250 may be more improved than a radiation efficiency 730 in a case that the first antenna 210 does not include the isolation element 219 disposed in the area adjacent to the second antenna 250.

The term "module" used herein may represent a unit including one of hardware, software and firmware or a combination thereof. The term "module" may be interchangeably used with the terms "unit", "logic", "logical block", "component" and "circuit". The "module" may be a minimum unit of an integrated component or may be a part thereof. The "module" may be a minimum unit for performing one or more functions or a part thereof. The "module" may be implemented mechanically or electronically. For example, the "module" may include at least one of an application-specific integrated circuit (ASIC) chip, a field-programmable gate array (FPGA), and a programmable-logic device for performing some operations, which are known or will be developed.

At least a part of devices (e.g., modules or functions thereof) or methods (e.g., operations) according to various embodiments of the present disclosure may be implemented as instructions stored in a computer-readable storage medium in the form of a program module. In the case where the instructions are performed by a processor (e.g., the processor 520), the processor may perform functions corresponding to the instructions. The computer-readable storage medium may be the memory 530.

The computer-readable recording medium may include a hard disk, a floppy disk, a magnetic medium (e.g., a magnetic tape), an optical medium (e.g., CD-ROM, DVD), a magneto-optical medium (e.g., a floptical disk), or a hardware device (e.g., a ROM, a RAM, a flash memory, or the like). The program instructions may include machine language codes generated by compilers and high-level language codes that can be executed by computers using interpreters. The above-mentioned hardware device may be configured to be operated as one or more software modules for performing operations of various embodiments of the present disclosure and vice versa.

A module or a program module according to various embodiments of the present disclosure may include at least one of the above-mentioned elements, or some elements may be omitted or other additional elements may be added. Operations performed by the module, the program module or other elements may be performed in a sequential, parallel, iterative or heuristic way. Furthermore, some operations may be performed in another order or may be omitted, or other operations may be added.

While the present disclosure has been shown and described with reference to certain embodiments thereof, it will be understood by those skilled in the art that various changes in form and details may be made therein without departing from the scope of the present disclosure. Therefore, the scope of the present disclosure should not be defined as being limited to the embodiments described herein, but should be defined by the appended claims and their equivalents.

What is claimed is:

1. An electronic device including a plurality of antennas, the electronic device comprising:

a first antenna configured to transmit and receive signals of a plurality of frequency bands; and a second antenna disposed at an area adjacent to the first antenna, wherein the first antenna comprises:

a first wireless communication circuit;

a first radiator;

a first feeding part configured to connect the first wireless communication circuit to the first radiator;

a first ground part configured to be connected to one end of the first radiator;

a switching circuit configured to be connected to the first radiator in an area adjacent to the second antenna;

at least one frequency band element in which a first end is connected to the switching circuit and a second end is connected to the first ground part; and at least one isolation element configured to connect the first radiator to the ground part in the area adjacent to the second antenna, wherein the at least one isolation element comprises at least one capacitance element or at least one inductance element, wherein the first antenna is not affected by the isolation element, wherein the second antenna is isolated by the isolation element, and wherein the at least one isolation element is connected to a ground area.

2. The electronic device of claim 1, wherein the at least one frequency band element comprises at least one capacitance element or at least one inductance element.

3. The electronic device of claim 2, wherein the first radiator is configured to be selectively connected to the at least one frequency band element according to a switching operation of the switching circuit and configured to transmit and receive a signal of a frequency band having a frequency range from 600 MHz to 990 MHz.

4. The electronic device of claim 1, wherein the first radiator is configured to be connected to at least one of the switching circuit and the at least one isolation element, through a connection part.

5. The electronic device of claim 4, wherein the connection part comprises a C-clip.

6. The electronic device of claim 1, further comprising a matching circuit having a predetermined impedance, wherein the matching circuit is configured to be connected to one end of the first feeding part.

7. The electronic device of claim 6, wherein the matching circuit comprises at least one capacitance element or at least one inductance element.

8. The electronic device of claim 1, further comprising a duplexer configured to separate a signal transmitted and a signal received through the first radiator, wherein the duplexer is configured to be connected to one end of the first feeding part.

9. The electronic device of claim 1, wherein the second antenna comprises:

a second wireless communication circuit;

a second radiator;

a second feeding part configured to connect the second wireless communication circuit to the second radiator;

a second ground part connected to one end of the second radiator; and a plurality of matching circuits, wherein a first end of each is connected to the second feeding part and a second end thereof is connected to the second radiator.

10. The electronic device of claim 9, wherein each of the plurality of matching circuits comprises at least one capacitance element or at least one inductance element.

11. The electronic device of claim 9, wherein the plurality of matching circuits comprise conductive lines to connect the second feeding part and the second radiator, and the conductive lines are configured to have different lengths.

12. An electronic device comprising:

a housing comprising a first surface facing a first direction, a second surface facing a second direction opposite to the first direction, and a side surface surrounding at least a portion of a space between the first surface and the second surface;

a first conductive member configured to be included in the housing or to form a portion of the housing;

a ground member configured to be included in the housing;

a switching circuit comprising a first terminal, a second terminal, and a third terminal, the first terminal configured to be electrically connected to a first point of the first conductive member;

a first circuit configured to be electrically connected between the second terminal of the switching circuit and the ground member, wherein the first circuit comprises at least one of a capacitance element and an inductance element;

a second circuit configured to be electrically connected between the third terminal of the switching circuit and the ground member, wherein the second circuit comprises at least one of a capacitance element and an inductance element;

a third circuit comprising at least one of a capacitance element and an inductance element, which is electrically connected to the first point of the first conductive member, the first terminal of the switching circuit, and the ground member;

a first wireless communication circuit configured to be electrically connected to a second point spaced apart from the first point of the first conductive member; and a conductive connection part configured to electrically connect a third point spaced apart from the first point of the first conductive member and the ground member.

13. The electronic device of claim 12, wherein the first wireless communication circuit is configured to transmit and receive a signal of a first frequency band having a frequency range from 600 MHz to 990 MHz.

14. The electronic device of claim 12, further comprising a second conductive member disposed in the vicinity of one end of the first conductive member and spaced apart from the first conductive member, wherein the first point of the first conductive member is closer to the second conductive member than the second point.

15. The electronic device of claim 14, further comprising a second wireless communication circuit electrically connected to the second conductive member, wherein the second wireless communication circuit is configured to transmit and receive a signal of a second frequency band that is at least partly different from the first frequency band.

16. The electronic device of claim 14, further comprising a non-conductive member, wherein the first conductive member and the second conductive member are configured to form at least a portion of the side surface of the housing, and the non-conductive member is disposed between the first conductive member and the second conductive member.

17. The electronic device of claim 16, further comprising a third conductive member disposed at an opposite position to the second conductive member with respect to the first conductive member, wherein the third point of the first conductive member is closer to the third conductive member than the second point.

18. The electronic device of claim 17, further comprising a non-conductive member, wherein the third conductive member is configured to form at least one other portion of the side surface of the housing, and the non-conductive member is disposed between the first conductive member and the third conductive member.

19. The electronic device of claim 18, wherein the second point of the first conductive member is disposed between the third point and the first point.

20. An electronic device comprising:

a wireless communication circuit;

a first antenna comprising a ground, a radiator, a feeding part, at least one frequency band element, and at least one isolation circuit; and a second antenna, wherein the ground is positioned on one end of the radiator, the at least one isolation circuit is positioned on an opposite end of the radiator, and the feeding part is positioned between the ground and the at least one isolation circuit, and wherein the at least one frequency band element is adjacent to the second antenna.

21. The electronic device of claim 20, wherein the first antenna further comprises a switching circuit configured to perform a switching operation connecting the radiator with the at least one isolation circuit, in an area adjacent to the second antenna.

22. The electronic device of claim 20, wherein the feeding part is configured to connect the wireless communication circuit to the radiator.

* * * * *